US010092152B2

(12) United States Patent
Scott et al.

(10) Patent No.: US 10,092,152 B2
(45) Date of Patent: Oct. 9, 2018

(54) SWEEPER WITH A SKIRT ASSEMBLY

(71) Applicant: Tennant Company, Minneapolis, MN (US)

(72) Inventors: Brett A. Scott, Eagan, MN (US); Michael S. Wilmo, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 529 days.

(21) Appl. No.: 14/680,723

(22) Filed: Apr. 7, 2015

(65) Prior Publication Data

US 2016/0296090 A1 Oct. 13, 2016

(51) Int. Cl.
*A47L 11/24* (2006.01)
*A47L 11/40* (2006.01)

(52) U.S. Cl.
CPC ..... *A47L 11/24* (2013.01); *A47L 11/4041* (2013.01); *A47L 11/4044* (2013.01); *A47L 11/4077* (2013.01)

(58) Field of Classification Search
None
See application file for complete search history.

(56) References Cited

U.S. PATENT DOCUMENTS 1,149,271 A 8/1915 Lazarus
3,892,008 A * 7/1975 Christensen ..... A47L 5/30 15/340.2
4,000,538 A * 1/1977 Tissier ..... A47L 11/305 15/320
4,805,256 A * 2/1989 Mason ..... A47L 11/283 15/320
5,659,921 A 8/1997 Narayan
6,018,844 A 2/2000 Basham et al.
8,099,828 B2 1/2012 Adelman et al.
8,584,294 B2 11/2013 Loring

* cited by examiner

*Primary Examiner* — Joseph J Hail
*Assistant Examiner* — Brian D Keller
(74) *Attorney, Agent, or Firm* — Fredrikson & Byron, P.A.

(57) ABSTRACT

Embodiments include a floor surface maintenance machine, comprising a cleaning tool chamber comprising a first side, a second side, a third side and a fourth side. A rotary broom is housed in the cleaning tool chamber and substantially enclosed by the first, second, third and fourth sides thereof. The rotary broom sweeps particulate from the surface. A vacuum system generates vacuum for drawing particulate swept by the rotary broom. The vacuum system is positioned proximal to the first side. A skirt assembly extends substantially around the second, third and fourth sides of the cleaning tool chamber. The skirt assembly has a vacuum passage defined therein and in fluid communication with the vacuum system to direct air flow into the vacuum passage, thereby drawing particulate into the vacuum passage and preventing particulate accumulation at portions of the second, third and fourth sides that are distal to the vacuum system.

21 Claims, 8 Drawing Sheets

SWEEPER WITH A SKIRT ASSEMBLY

FIELD

This disclosure generally relates to surface maintenance machines. More particularly the present disclosure relates to a skirt assembly for use with such machines.

BACKGROUND

Surface maintenance machines include vehicles and devices that can be self-powered, towed, or pushed, and/or manually powered. Surface maintenance machines commonly include a cleaning head having one or more cleaning tools (e.g., a rotating drum brush) operated by one or more motors. Each cleaning tool is configured to perform a desired treating operation on the floor surface. For example, in cases where the surface maintenance machine is a floor floor surface maintenance machine, one or more brushes sweep dirt and debris from a floor surface and throw loose debris into a hopper. The brush may be housed in a cleaning tool chamber in such cases.

Typically during the operation of a sweeper, sweeping tools that move and direct debris and generate particulate may cause adverse air currents that can be hard to control. In such cases, a vacuum system directing airflow in a predetermined direction can be commonly used to control the particulate and adverse air currents that are generated during the sweeping process. The floor surface maintenance machine may also include skirt assemblies comprising a single row of skirts on the lateral sides and/or rear of the machine, under which vacuum may be generated by the vacuum system thereby drawing particulate toward the hopper. Dusting may still occur at the side skirt assemblies due to one or more reasons such as reduced airflow from the vacuum system, air currents due to the rotating broom, skirt mis-adjustment, or skirt damage.

SUMMARY OF THE INVENTION

Certain embodiments of the invention include a floor surface maintenance machine, comprising a body and wheels for supporting the body for movement over a surface. The floor surface maintenance machine can include a cleaning tool chamber housed toward a bottom portion of the body. The cleaning tool chamber can comprise a first side, a second side, a third side and a fourth side. A rotary broom can be housed in the cleaning tool chamber and substantially enclosed by the first, second, third and fourth sides thereof. The rotary broom can extend from a bottom surface of the body of the floor surface maintenance machine and sweep particulate from the surface on which the machine is traveling. The floor surface maintenance machine can comprise a vacuum system for generating vacuum for drawing particulate swept by the rotary broom. In an embodiment, the vacuum system is positioned proximal to the first side of the cleaning tool chamber. The floor surface maintenance machine can comprise a skirt assembly extending substantially around the second, third and fourth sides of the cleaning tool chamber. The skirt assembly has a vacuum passage defined therein and in fluid communication with the vacuum system to direct air flow into the vacuum passage, thereby drawing particulate into the vacuum passage and preventing particulate accumulation at portions of the second, third and fourth sides that are distal to the vacuum system. In an embodiment, the skirt assembly extends substantially around the lateral sides and the rear side of the cleaning tool chamber.

In certain embodiments, the skirt assembly comprises an inner skirt positioned proximal to the rotary broom and an outer skirt spaced apart from the inner skirt. The inner and outer skirt define a vacuum passage for drawing particulate swept by the rotary broom. The inner and outer skirt are positioned such that the outer skirt is prevented from contacting a surface on which the floor surface maintenance machine is positioned and the inner skirt is prevented from being deflected when the inner skirt contacts the surface on which the floor surface maintenance machine is positioned.

BRIEF DESCRIPTION OF DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
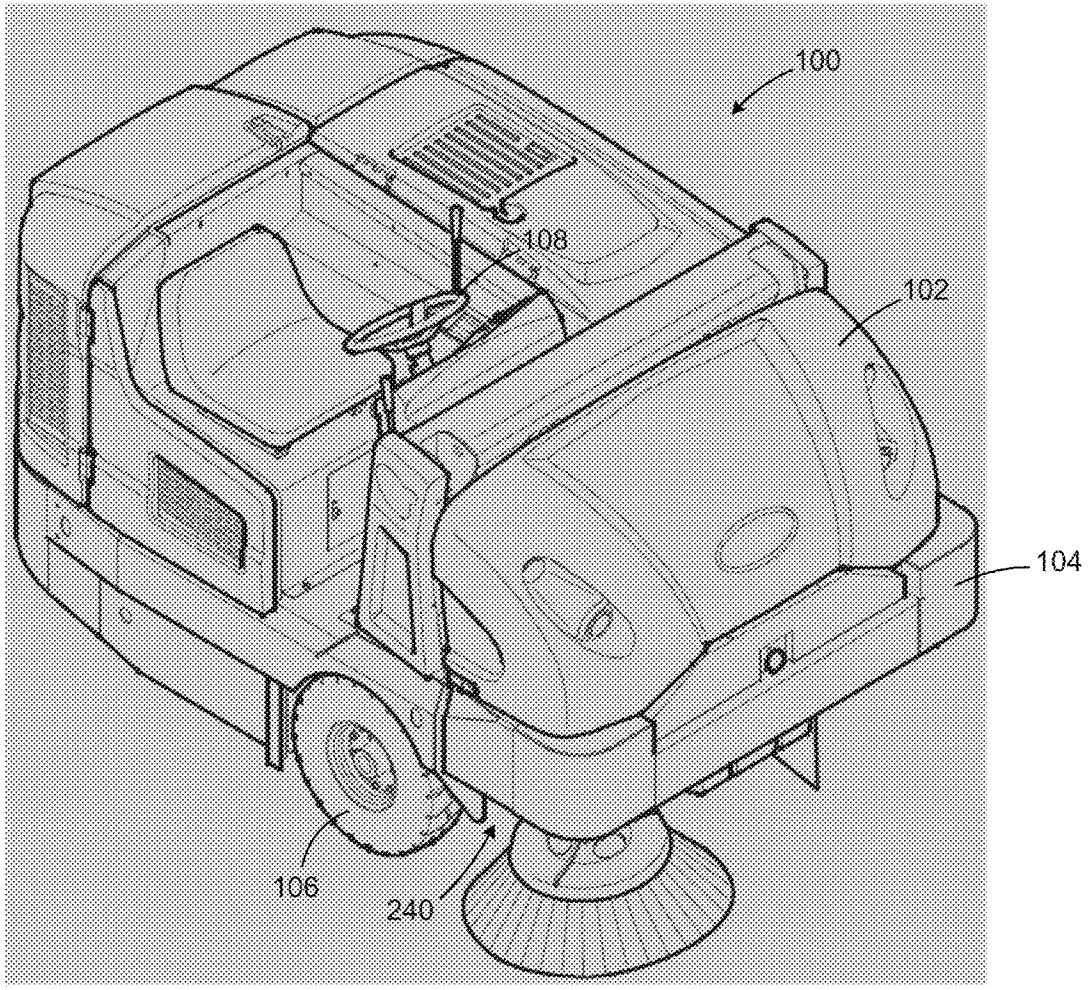
FIG. 1 is a perspective view of a surface maintenance machine according to an embodiment.

FIG. 1 is a perspective view of an exemplary surface maintenance machine 100. In the illustrated embodiment shown in FIG. 1, the surface maintenance machine 100 is a ride-on machine 100 used to treat hard floor surfaces. In other embodiments, the surface maintenance machine 100 can be a walk-behind machine 100 or a towed-behind machine 100, such as the surface maintenance machine 100 described in U.S. Pat. No. 8,584,294 assigned to Tennant Company of Minneapolis, Minn., the disclosure of each of which is hereby incorporated by reference in its entirety. The surface maintenance machine 100 can perform maintenance tasks such as sweeping (e.g., removing dust, debris or other particulate from the floor surface). In some cases, the machine 100 is a mechanical sweeper configured for mechanically moving particulate from the floor surface 152. Alternatively, the machine 100 can be a combination sweeper-scrubber, or a burnisher. Other operations such as scrubbing, polishing (burnishing) a surface 152 are also contemplated. The surface 152 can be a floor surface 152, pavement, road surface 152 and the like.

Embodiments of the surface maintenance machine 100 include components that are supported on a mobile body 102. As best seen in FIG. 1, the mobile body 102 comprises a frame 104 supported on wheels 106 for travel over a surface 152, on which a surface 152 maintenance operation is to be performed. The mobile body 102 may include operator controls (not shown) and a steering control such as a steering wheel 108. The surface maintenance machine 100 can be powered by an on-board power source such as one or more batteries, a fuel-cell, or an internal combustion engine (not shown). The power source can be proximate the front of the surface maintenance machine 100, or it may instead be located elsewhere, such as within the interior of the surface maintenance machine 100, supported within the frame 104, and/or proximate the rear of the surface maintenance machine 100. Alternatively, the surface maintenance machine 100 can be powered by an external electrical source (e.g., a power generator) via an electrical outlet. The interior of the surface maintenance machine 100 can include electrical connections (not shown) for transmission and control of various components.

Figure 2:
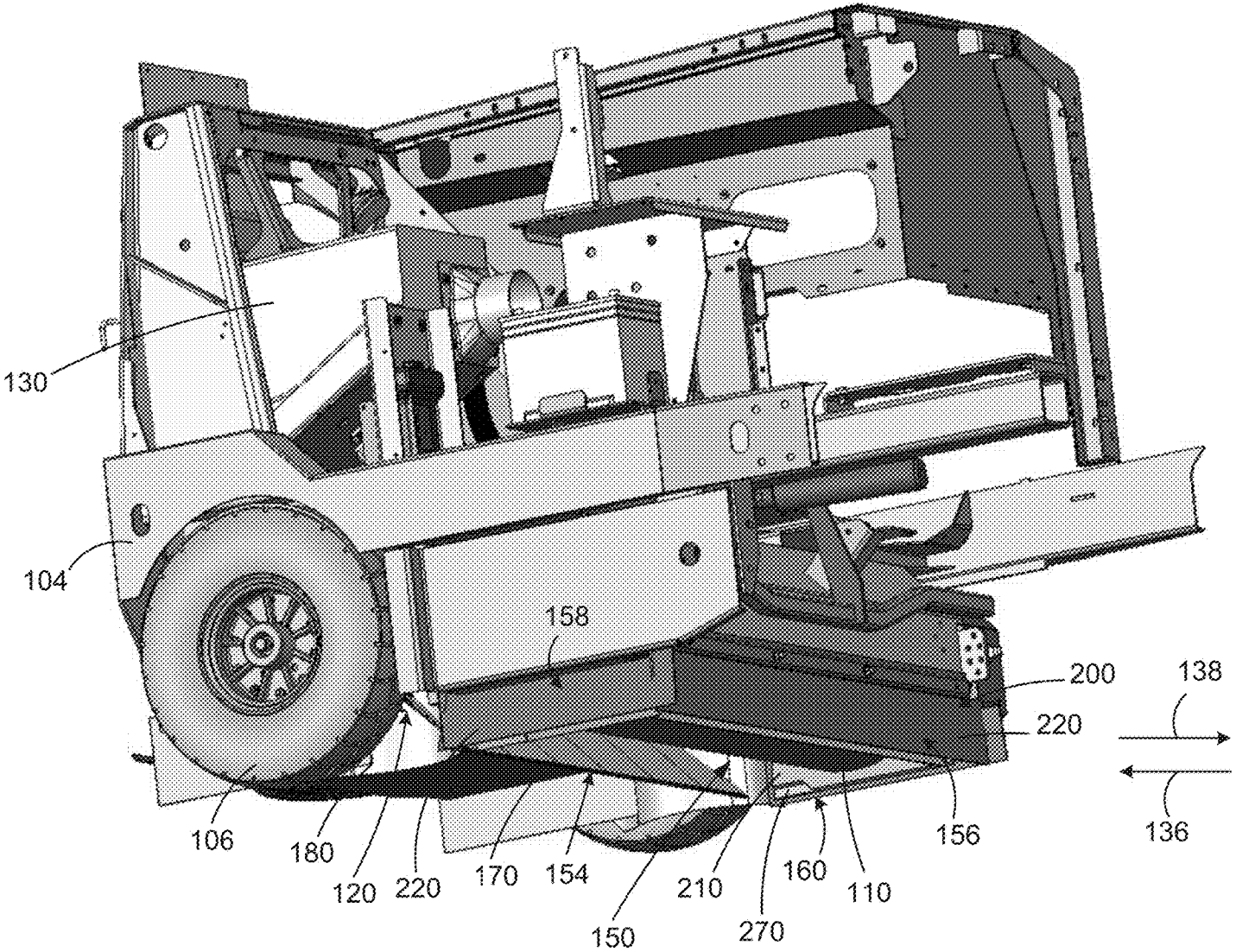
FIG. 2 is a perspective view of the surface maintenance machine of FIG. 1 showing certain internal features of the machine.

The machine 100 can include a cleaning tool for performing one or more cleaning tasks. For instance, the cleaning tool can perform sweeping, scrubbing, polishing/burnishing and the like. Many different types of cleaning tools are used to perform such cleaning operations on the floor surface 152. These include sweeping, scrubbing brushes, polishing/burnishing and/or buffing pads. In the embodiments illustrated herein, the machine 100 is a floor surface maintenance machine 100 wherein the cleaning tool can be one or more rotary brooms 110. While FIG. 2 shows a single rotary broom 110, the floor surface maintenance machine 100 can include more than one rotary brooms 110, and/or disc-shaped brushes. Alternatively, the machine 100 can be a combination sweeper-scrubber in which case the machine 100 can include one or more scrub-brushes in addition to the broom 110, or a burnisher in which case the machine 100 can include one or more burnishing/polishing pads. The broom 110 can extend from the underside of the machine 100 and can be supported by an elongated cleaning head. The machine 100 includes a cleaning head assembly. While not illustrated, the cleaning head assembly can house other cleaning tools (e.g., side brooms, scrubbing brush, and burnishing/polishing pads). The cleaning head assembly can be attached to the body 102 of the machine 100 such that the cleaning head can be lowered to a cleaning position and raised to a traveling position. The cleaning head assembly is connected to the machine 100 using any known mechanism, such as a suspension and lift mechanism such as those illustrated in U.S. Pat. No. 8,584,294 assigned to Tennant Company of Minneapolis, Minn., the disclosure of each of which is hereby incorporated by reference in its entirety. The rotary broom 110 can be releasably loaded to or unloaded from the surface maintenance machine 100.

Figure 3B:
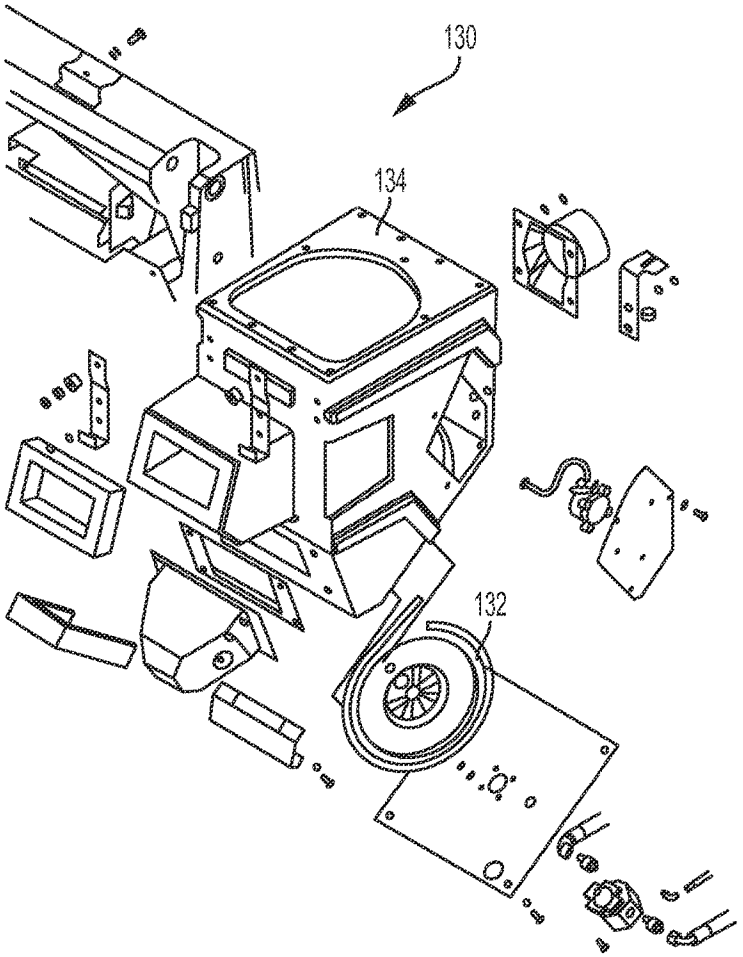
FIG. 3B is an exploded perspective view of vacuum system according to an embodiment.
Figure 3A:
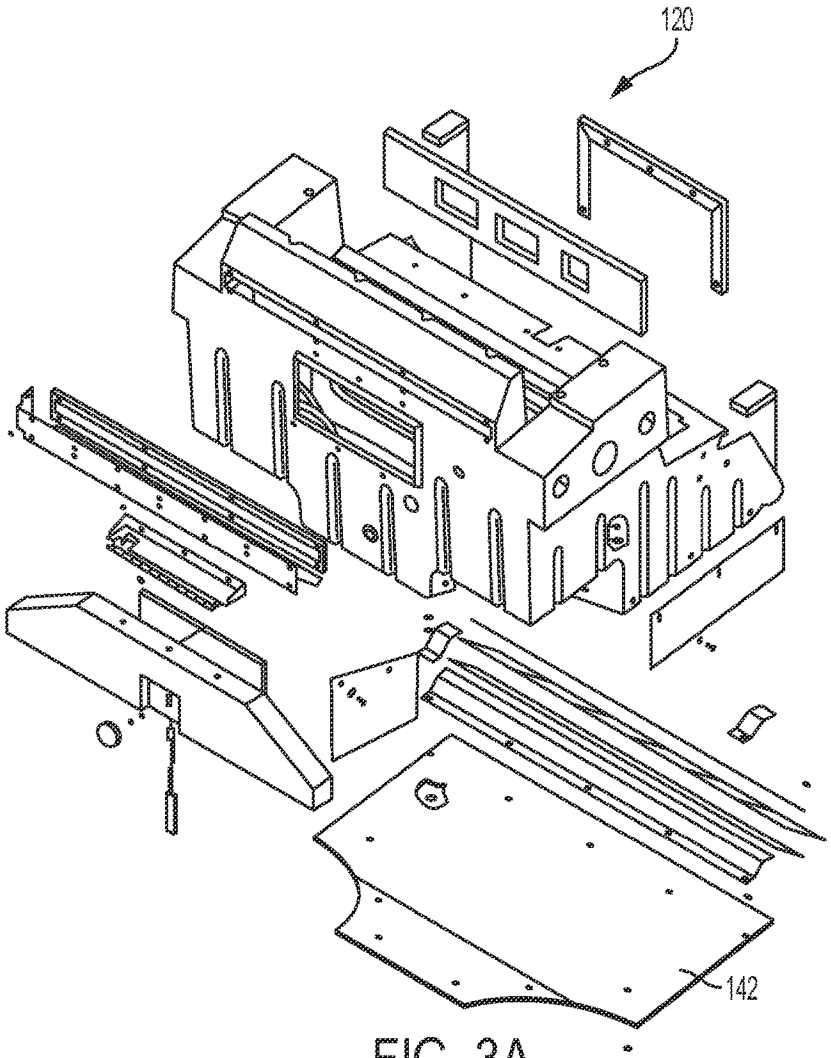
FIG. 3A is an exploded perspective view of a hopper according to an embodiment.

As shown in the perspective view of FIG. 2, the machine 100 can include a hopper 120 (best shown in FIG. 3A) and a vacuum system 130 (best shown in FIG. 3B). The vacuum system 130 best illustrated in FIG. 3B can comprise a vacuum source 132, such as a fan housed in a fan housing 134. In some cases, the vacuum system 130 can include a filtration system including a filter and other components which provide for support and function thereof. In the illustrated embodiment, the hopper 120 is positioned toward the front of the machine 100 when the machine 100 is moving in a generally forward direction (e.g., along arrows 136 illustrated in FIG. 2). In the illustrated embodiment, direction 138 represents backward direction. Alternatively, the hopper 120 can be positioned toward the back of the machine 100, when the machine 100 is moving in a generally forward direction (e.g., along arrows 136 illustrated in FIG. 2). The hopper 120 shown in FIG. 3A comprises a plenum 140 and associated plenum panels 142 located at the upper region of the hopper 120. The plenum 140 can house and support the filtration system (not shown) and/or components of the vacuum system 130 shown in FIG. 3B. The fan can be attached to a hopper 120 panel or, alternatively, may be mounted within the plenum 140 (as illustrated in FIG. 2), above the plenum 140, or external to the plenum 140 via an air conduit (not shown). The filtration system, while not illustrated, can include one or more filters. One example of a filtration system is described in the commonly-assigned U.S. Pat. No. 8,099,828, the disclosure of which is hereby incorporated by reference. In operation, the vacuum source 132 generates an airflow such that air flows through the filtration system and into the hopper 120. An inlet 144 of the vacuum system 130 is adjacent to the rotary broom 110.

Figure 5B:
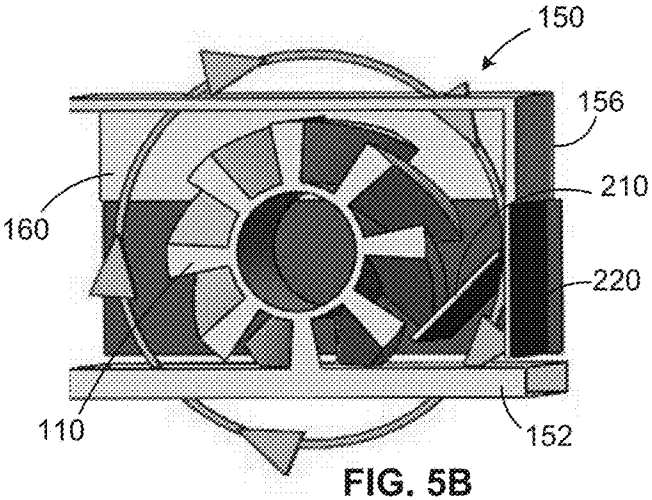
FIG. 5B is a side perspective view illustrating the cleaning tool chamber of FIG. 4 with the side skirts on the lateral side removed for illustrating internal features.
Figure 5A:
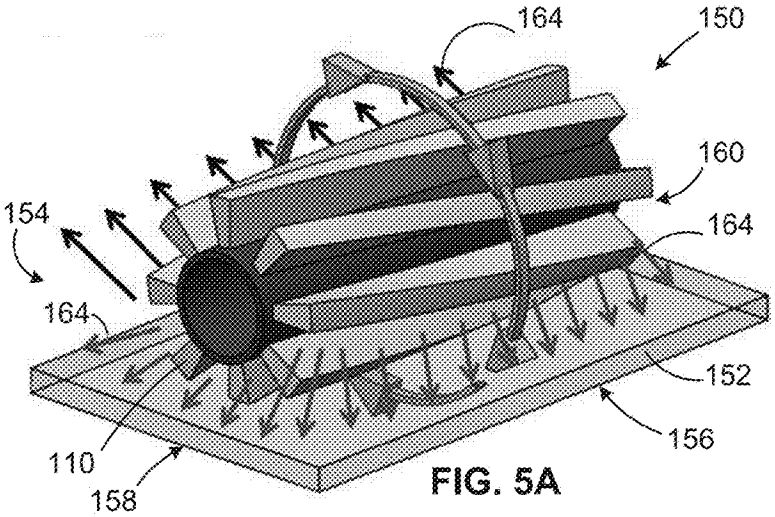
FIG. 5A is a schematic illustrating a perspective view of the rotating broom according to an embodiment in the cleaning tool chamber shown in FIG. 4.
Figure 5C:
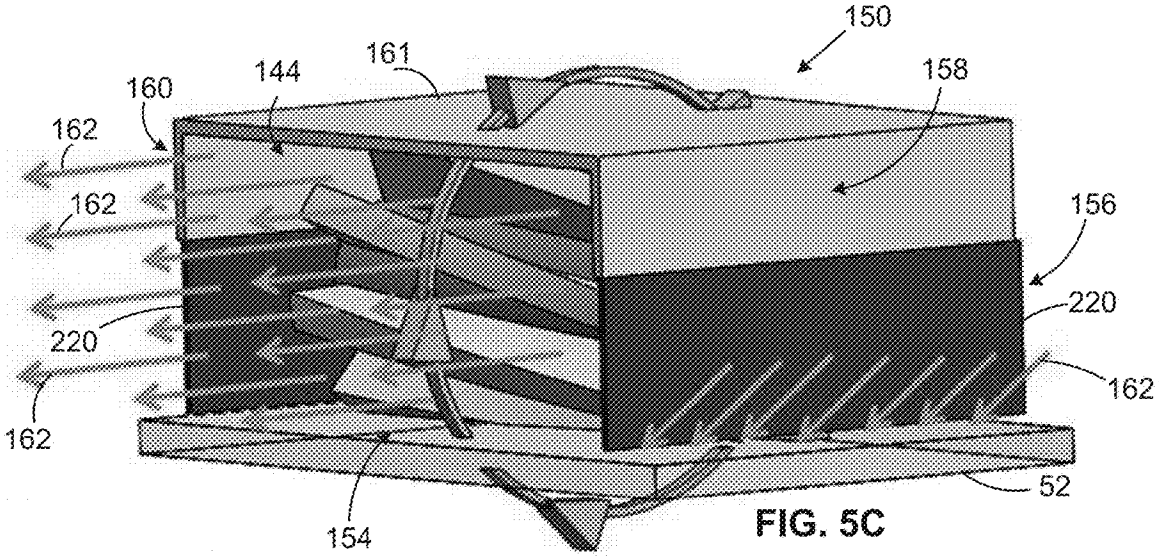
FIG. 5C is a side perspective view of the cleaning tool chamber shown in FIG. 4 illustrating airflow direction toward the hopper.

Referring back to FIG. 2, in some cases, the rotary broom 110 can rotate within and be housed in a cleaning tool chamber 150. In cases where the machine is a combination sweeper-scrubber, or a burnisher, the cleaning tool chamber 150 can hold other cleaning tools (e.g., a scrub brush, a burnishing pad and the like) raised and lowered by a cleaning head (not shown). Portions of the cleaning tool chamber 150 with associated airflow schematics are shown in FIGS. 5A-5C. The broom can sweep particulate from a surface 152 and push particulate from the surface 152 into the hopper 120 (not shown in FIGS. 5A-5C) as it rotates within the cleaning tool chamber 150. The cleaning tool chamber 150 can be vacuumized and can communicate with the hopper 120. The cleaning tool chamber 150 can be positioned toward the rear of the transverse axis 232 of the machine 100 when the machine 100 is moving in a generally forward direction (e.g., along arrows 136 illustrated in FIG. 2). The cleaning tool chamber 150 as shown in FIG. 5C can be defined by a first side 154, a second side 156, a third side 158 and a fourth side 160. The rotary broom 110 can be substantially enclosed by the first, second, third and fourth sides 154, 156, 158, 160 of the cleaning tool chamber 150. Additionally, the rotary broom 110 can be substantially enclosed by a fifth side 161 of the cleaning tool chamber 150. At least one side of the cleaning tool chamber 150 can be distal to the hopper 120 and the vacuum system 130. For example, in the embodiment illustrated in FIGS. 5B and 5C, the second side can be distal to the hopper 120. As mentioned elsewhere herein, the hopper 120 can be positioned toward the front of the machine 100 (as the machine 100 moves generally forward). In such cases, the first side 154 can be adjacent to the hopper 120. The first side 154 can be open, and face the components of the vacuum system 130. For example, the first side 154 can be adjacent to the inlet 144 of the vacuum system 130 and form the front side of the cleaning tool chamber 150, and the second side 156 can be the rear side of the cleaning tool chamber 150. The third and fourth sides 158, 160 can be lateral sides (e.g., lateral to the second side 156) of the cleaning tool chamber 150. The fifth side 161 can be a top side 161 of the cleaning tool chamber 150. The top side 161, sometimes referred to as a "brush wrap" can optionally be contoured to follow the shape of the rotary broom 110. Alternatively, the top side 161 can be planar, and be formed by an element (e.g., a panel) of the frame 104 of the machine.

Referring back to FIG. 2, the rotary broom 110 extends from a bottom surface 152 of the body 102 of the machine 100 and is rotatable. The rotation of the broom can be driven by a driver (e.g., a motor, not shown). In some cases, the broom can rotate at speeds of between about 100 rotations per minute and about 400 rotations per minute. The rotation of the rotary broom 110 generates air currents within the cleaning tool chamber 150. As the broom rotates, particulate are picked up (e.g., swept) from the floor and acted upon by the vacuum system 130 as will be described below. In some cases, at certain broom rotation speeds, the debris or particulate is pushed directly into the hopper 120. At other rotational speeds, particulate may bounce around in the cleaning tool chamber 150. In some such cases, as illustrated in FIG. 2, a deflection panel 170 can be positioned adjacent to the first side of the cleaning tool chamber 150. The deflection panel 170 can direct particulate into the hopper 120 at rotation speeds wherein particulate bounces in the cleaning tool chamber 150. In some cases, one or more deflectors 180 can be positioned proximal to the deflection panel 170. The deflector 180 can additionally direct any debris impinging thereupon into the hopper 120. Such embodiments can be beneficial when the broom rotates at speeds other than optimal speed for ideally directing all the debris into the hopper 120.

Referring again to FIGS. 5A-5C, in some cases, the air currents due to broom rotation can have an associated positive pressure therewith such that particulate may sometimes be thrown off towards the outside of the machine 100. For example, in the embodiments illustrated herein, the rear side of the cleaning tool chamber 150 may not be in vacuum communication with the vacuum system 130, and due to air currents generated by the rotating broom, dusting may occur. In such cases, vacuum may not act upon portions of the cleaning tool chamber 150 that are distal to the vacuum source 132 and/or acted upon by turbulence generated due to broom rotation. In such cases, vacuumized airflow may be precisely channeled for particulate control and/or to isolate vacuum from air currents generated by the rotating broom. Accordingly, this disclosure provides embodiments with adequate vacuumized airflow around the lateral and rear sides 156, 158, 160 of the cleaning tool chamber 150 to control particulate so as to direct airflow as shown by arrows 162 in FIG. 5C.

In some cases, the machine 100 comprises a skirt assembly 200 as shown in FIGS. 4 and 5A-5C for preventing dusting due to air currents generated by the broom. In such cases, the skirt assembly 200 can extend substantially around the second, third and fourth sides 156, 158, 160 of the cleaning tool chamber 150. The skirt assembly 200 substantially encloses the cleaning tool chamber 150 except on the first side 158 of the cleaning tool chamber 150. For instance, the skirt assembly 200 can substantially surround a perimeter of the lateral and rear sides 156, 158, 160 of the cleaning tool chamber 150 as shown in FIGS. 4 and 5A-5C, wherein the rear side of the cleaning tool chamber 150 is distal to the vacuum system 130. The second side 160 of the cleaning tool chamber 150 is opposite to the inlet of the vacuum system 130. As will be described below, the skirt assembly 200 can prevent particulate accumulation at portions of the second, third and fourth sides 156, 158, 160 that are distal to the vacuum system 130.

Figure 4:
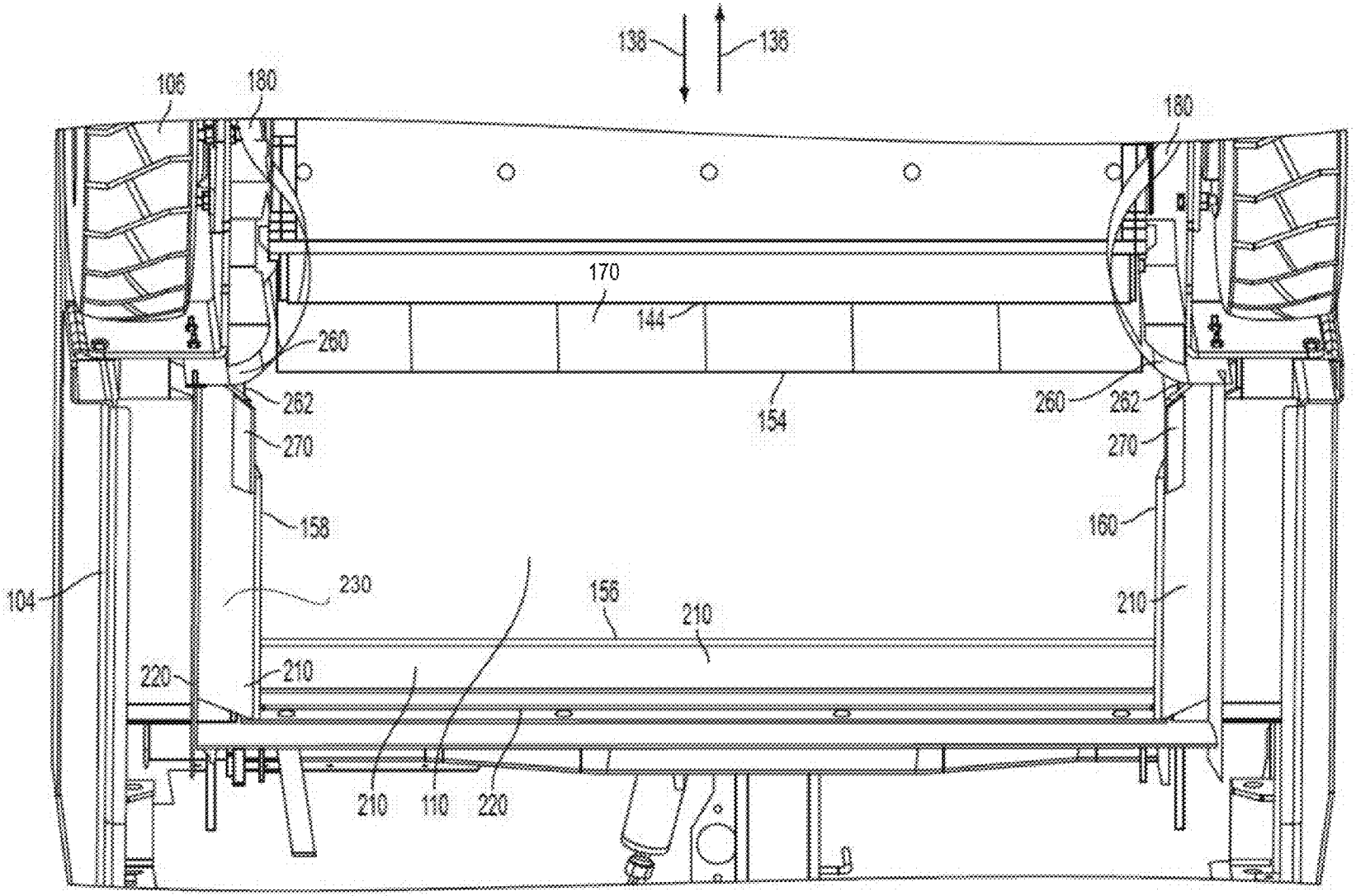
FIG. 4 is a bottom plan view of a cleaning tool chamber according to an embodiment.

As seen in FIG. 4, the skirt assembly 200 comprises a first skirt 210 installed around lateral and rear perimeter 156, 158, 160 of the cleaning tool chamber 150, and a second skirt 220 spaced apart from the first skirt 210. The first and second skirts, when spaced apart from each other, create a vacuum passage 230. Alternatively, the skirt assembly 200 can comprise a single skirt having a hollow gap to create the vacuum passage 230. The skirt assembly 200 can be a separate component, or be integral with the frame of the machine 100. For example, the skirt assembly 200 can be formed by components of the frame 104 such that the skirt assembly 200 comprises one or more walls with a vacuum passage 230 therebetween. The first skirt 210 can be an inner skirt 210 positioned adjacent the rotary broom 110, and the second skirt 220 can be an outer skirt 220 spaced apart from the inner skirt 210 as illustrated in FIG. 4. The inner skirt 210 can act as a barrier to airflow from the cleaning tool chamber 150 into the vacuum passage 230. For example, the skirt assembly 200 can be configured such that air flow is substantially from the lateral and rear side 156, 158, 160 of the machine 100 toward the hopper 120, and any air flow from the cleaning tool chamber 150 toward the vacuum passage 230 (e.g., as shown by the arrows 164 in FIG. 5A) is avoided.

With continued reference to FIGS. 4 and 5C, the vacuum passage 230 defined in the skirt assembly 200 can be in fluid communication with the vacuum system 130 to direct air flow from the rear and lateral sides 156, 158, 160 of the cleaning tool chamber 150 into the vacuum passage 230, thereby drawing particulate into the vacuum passage 230. The vacuum passage 230 can direct air flow in the vacuum passage 230 toward the hopper 120, such that particulate are pulled by the vacuum source 132 into the vacuum passage 230 defined around the lateral and rear perimeter 156, 158, 160 of the cleaning tool chamber 150, thereby preventing particulate accumulation at portions of the lateral sides 158, 160 and the rear side 156 of the cleaning tool chamber 150, such as portions that are positioned distal to the vacuum source 132. Unlike typical skirt assemblies known in the art comprising a single row of skirts, skirt assembly 200 comprising dual skirts such as those disclosed herein can improve particulate control by defining a vacuum passage 230 for directing the flow toward the hopper 120.

The inner and outer skirts can be made of polymers. For instance, the inner skirt 210 and outer skirt 220 can be made of one or more layers of fabric reinforced neoprene or urethane. Other suitable materials are also contemplated. The outer skirt 220 on the lateral and rear sides 156, 158, 160 and inner skirt 210 on the rear sides 156 of the cleaning tool chamber 150 can be made of one or more layers of fabric reinforced neoprene or urethane. The inner skirt 210 on the lateral sides 158, 160 is of a thickness greater than the outer skirt 220 on the lateral sides 158, 160 of the cleaning tool chamber 150. This is because, in some cases, the inner skirt 210 may contact the rotating broom, and may have to be prevented from wear due to contact with the rotary broom 110. The inner skirt 210 on the lateral side 158, 160 is typically rigid and is of a rugged construction to withstand damage due to contact with rotating broom and/or bumps in the surface 152. The rigidity of the inner skirt prevents closure of the vacuum passage. For example, the inner skirt may not deflect such that the vacuum passage is intercepted, thereby preventing airflow and "closing off" vacuum in the vacuum passage. Such embodiments are beneficial and improve particulate control in comparison to known skirt assemblies because even in the event of misadjustment or damage to a skirt, the addition of a second skirt 220 can continue providing particulate control.

Figure 9:
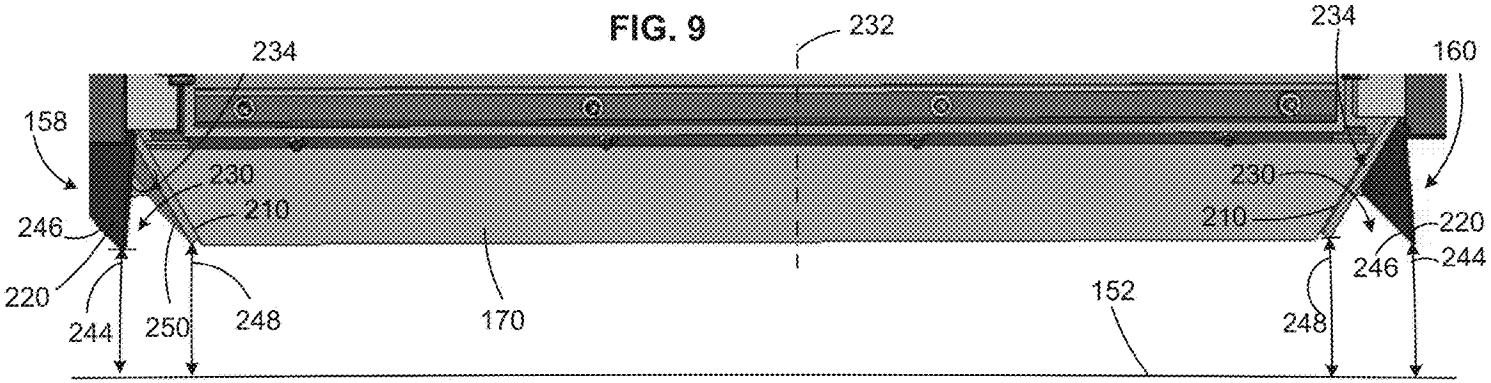
FIG. 9 is a front perspective view of the skirt assembly according to an embodiment.

Optionally, as the inner skirt 210 contacts the rotating broom, the inner skirt 210 is angled toward a transverse axis 232 of the machine 100 (best illustrated in FIG. 9). The transverse axis 232 is substantially perpendicular to the surface 152 on which the floor surface maintenance machine 100 is positioned. In such cases, the inner skirt 210 forms an angle 234 of between about 20 degrees and about 60 degrees with the outer skirt 220. In the embodiment illustrated in FIGS. 3 and 4, and as best seen in FIG. 9, the angle 234 between the inner skirt 210 and the outer skirt is about 30°. The vacuum passage 230, as best seen in FIG. 9 has a triangular cross-section when viewed along the rear side of the cleaning tool chamber in such cases. Alternatively, the inner and outer skirts 210, 220 can be vertical with respect to the floor surface 152 on which the machine 100 is positioned. In such cases, the vacuum passage 230 has a rectangular cross-section. Generally, the cross-section of the vacuum passage 230 can have any desired shape.

Figure 6:
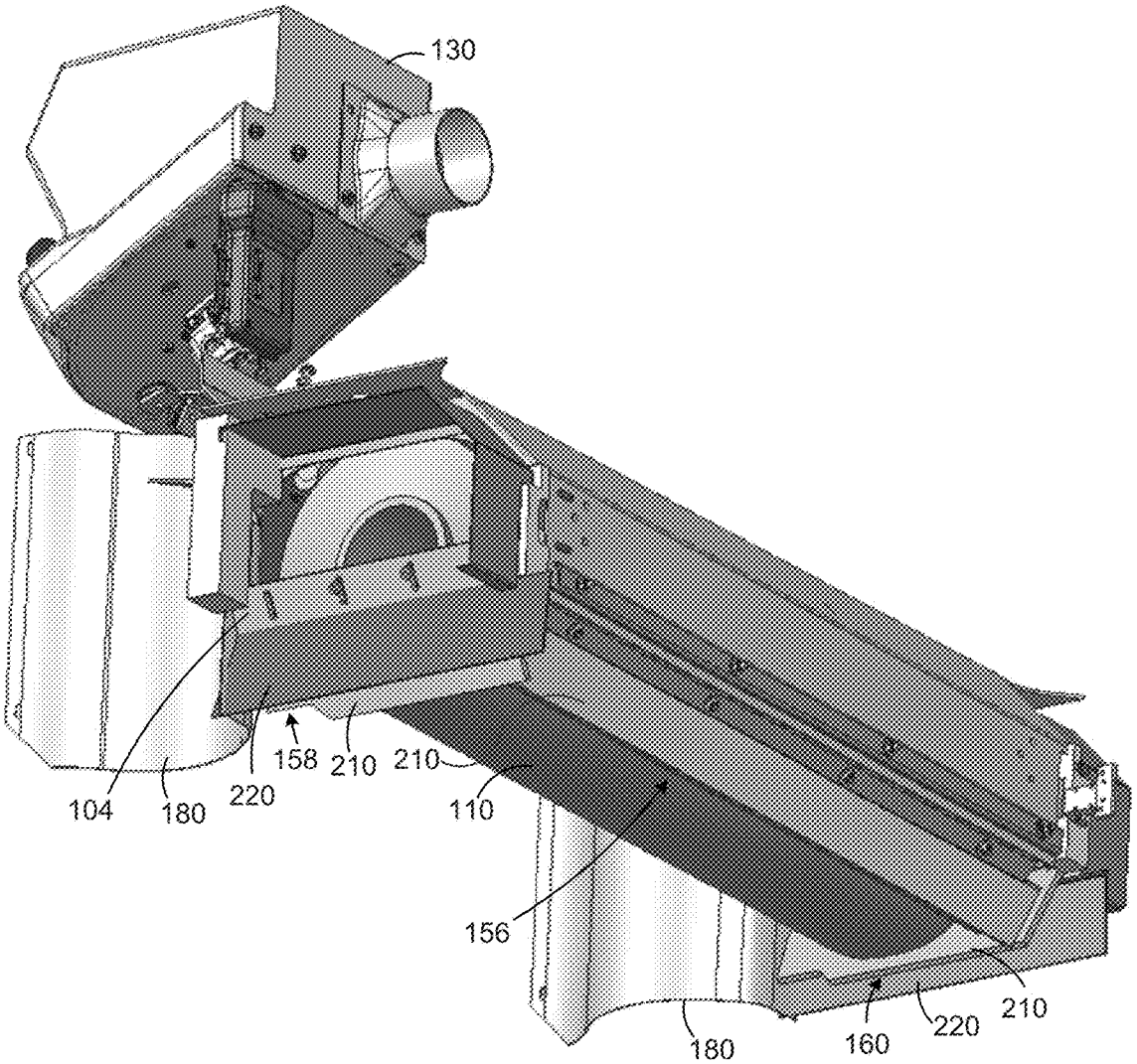
FIG. 6 is a side perspective view of the cleaning tool chamber of FIG. 4 illustrated together with the vacuum system shown in FIG. 3B.

Referring back to FIG. 4, the skirts can be mounted from components of the frame 104 of the machine 100 from a bottom portion 240 of the machine 100. For instance, as shown in FIGS. 4 and 6, the skirts can be mounted from slots on frame 104 elements of the machine 100 by bolts or other fasteners 242. In some cases best seen in FIG. 9, the outer skirt 220 is positioned such that a first gap 244 is formed between an edge 246 of the outer skirt 220 and the surface 152 on which the floor surface maintenance machine 100 is positioned. The inner skirt 210 is positioned such that second gap 248 is formed between an edge 250 of the inner skirt 210 and the surface 152 on which the floor surface maintenance machine 100 is positioned. The first gap 244 between the outer skirt 220 and the surface 152 is in fluid communication with the vacuum passage 230 such that particulate proximal to the outer skirt 220 is drawn into the vacuum passage 230 through the gap. Typically both the inner and outer skirts are mounted such that the first and second gaps are both between about 0.1 inches and 0.25 inches (e.g., 0.125 inches) from the floor surface 152. However, the inner skirt 210 may move toward the floor surface 152 because the inner skirt 210 contacts the rotating broom, thereby reducing or eliminating ground clearance between the inner skirt 210 and the surface 152 on which the surface maintenance machine 100 is positioned as will be described further below. The broom may, due to its rotation, bring down the inner skirt 210 toward the floor surface 152. In some such cases, the inner skirt 210 contacts the surface 152 on which the floor surface maintenance machine 100 is positioned during routine use of the machine 100.

Figure 7:
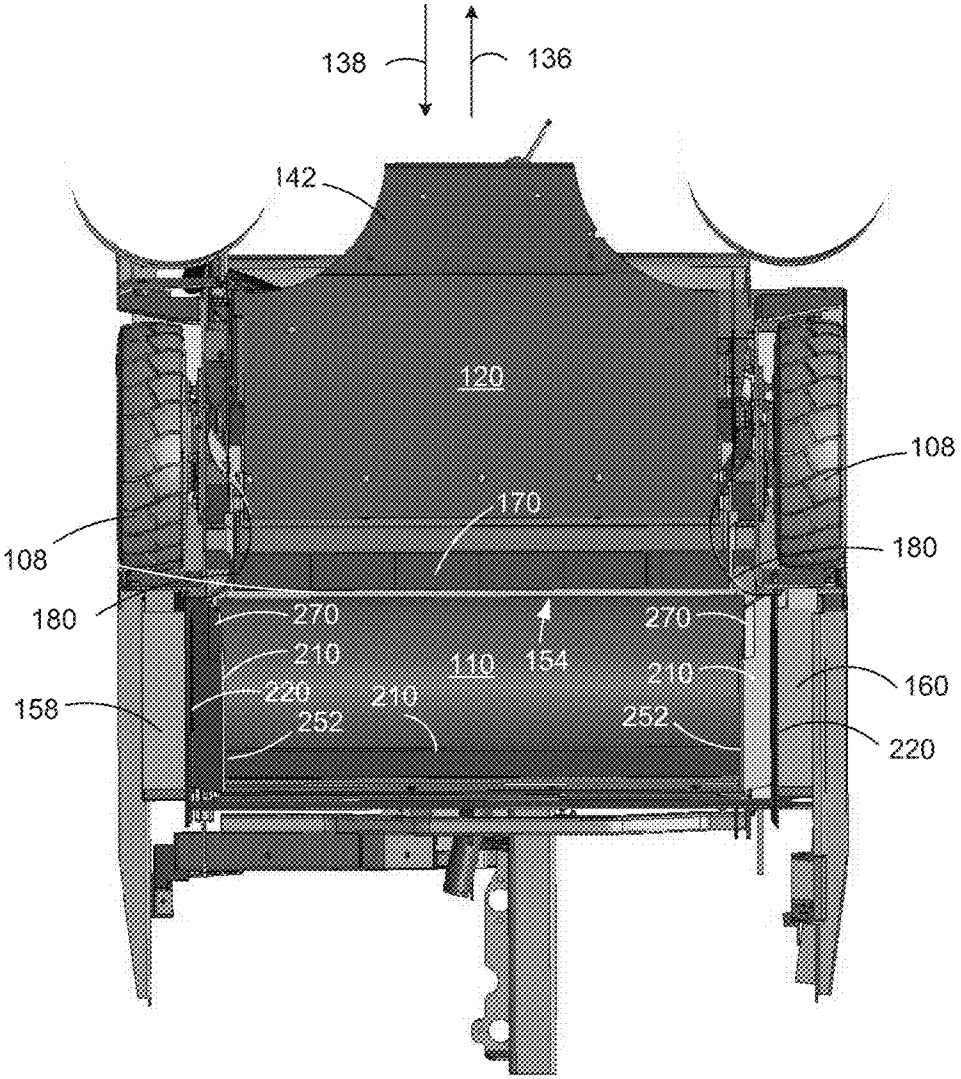
FIG. 7 is a bottom perspective view of the cleaning tool chamber of FIG. 4.
Figure 8:
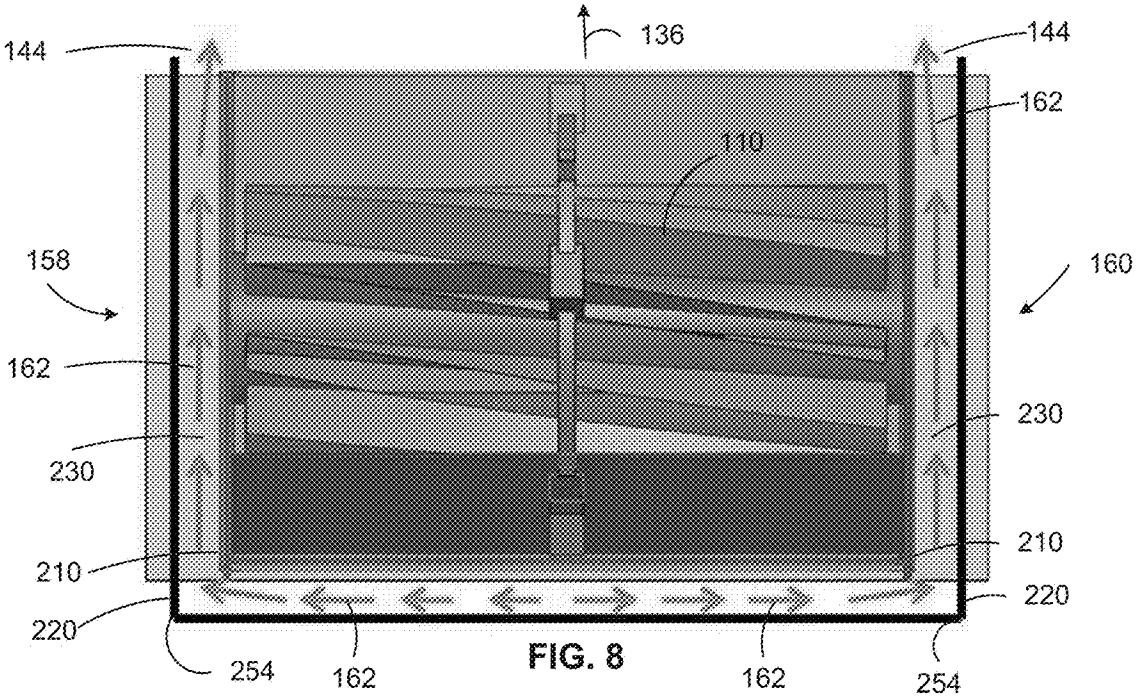
FIG. 8 is a schematic illustrating airflow through a vacuum passage of a skirt assembly according to an embodiment.

In certain embodiments as shown in FIGS. 7 and 8, the inner skirt 210 substantially isolates the vacuum passage 230 from the cleaning tool chamber 150. The inner skirt 210 isolates the vacuum passage 230 from the cleaning tool chamber 150 such that air currents generated by the rotary broom 110 is fluidly isolated from vacuum generated by the vacuum system 130 in the vacuum passage 230. As shown in FIGS. 5C and 8, air is drawn into the vacuum passage 230 along the arrows 162 shown in FIGS. 5C and 8. In this embodiment, the direction shown by the arrows 162 indicates airflow toward the front of the machine 100. As described previously with respect to FIGS. 3A and 3B, the hopper 120 and the vacuum source 132 are positioned toward the front of the machine 100. Referring again to FIG. 8, the skirt assembly 200 isolates the lateral and rear sides 156, 158, 160 of the cleaning tool chamber 150 such that the positive pressure due to air currents in the cleaning tool chamber 150 is fluidly isolated from vacuum prevailing in the vacuum passage 230. As a result of the isolation provided by the skirt assembly 200, airflow in the cleaning tool chamber 150 does not generally affect vacuum airflow in the vacuum passage 230. For example, air does not escape from the lateral and rear side 156, 158, 160 of the cleaning tool chamber 150 toward the exterior of the machine 100.

As perhaps best seen in the schematic view of FIG. 8 and bottom perspective view of FIG. 7, the skirts on the lateral sides 158, 160 of the cleaning tool chamber 150 are disposed such that an edge 252 of the inner skirt 210 on the rear side 156 of the cleaning tool chamber 150 intersects the inner skirt 210 on the lateral side 158, 160 of the cleaning tool chamber 150. Similarly at least one edge of one of the inner or outer skirt 220 on the rear side 156 of the cleaning tool chamber 150 can contact the inner or outer skirt 220 on the lateral side 158, 160 of the cleaning tool chamber 150. For example, the outer skirt 220 on the rear 156 can have an edge 254 that contacts the outer skirts 220 on the lateral sides 158, 160. As a result, the vacuum passage 230 can have a C-shaped orientation as illustrated in FIG. 8. In this configuration, there are no gaps in the skirt assembly 200 as a result of which the cleaning tool chamber 150 is completely fluidly isolated from the vacuum passage 230 formed by the skirt assembly 200. As mentioned elsewhere herein, the skirt assembly 200 can be formed by a single skirt with a hollow portion forming the vacuum passage 230 instead of an inner skirt 210 and an outer skirt 220. In such cases, the single skirt can be formed (e.g., by molding) into a C-shaped orientation as illustrated in FIG. 8. Because the skirt assembly 200 in such cases is a one-piece unitary structure, there are no gaps for air flow from the cleaning tool chamber 150, and the vacuum passage 230 is completely fluidly isolated therefrom.

As described previously with respect to FIGS. 2 and 4, the floor surface maintenance machine 100 comprises a deflector 180 for directing dirt into the hopper 120. As best seen in FIGS. 2 and 4, the deflector 180 can be positioned proximal to the deflection panel 170 and the vacuum passage 230 to direct debris into the hopper 120. The deflector 180 can be curved, rounded, or angled such that the deflector 180 is prevented from intercepting the entrance to the vacuum passage 230 and thereby facilitating air flow from near the lateral sides 158, 160 and rear side 156 of the cleaning tool chamber 150 toward the front side of the cleaning tool chamber 150. In the embodiments illustrated in FIGS. 2 and 4, and as perhaps best seen in FIG. 6, the deflector 180 has a S-shaped profile when viewed from the bottom. At least a portion 260 of the deflector 180 can be directed away from the entrance of the vacuum passage 230 so that the deflector 180 does not block flow from the vacuum passage 230 toward the hopper 120. In such cases, the deflector 180 forms a gap 262 between the deflector 180 and the entrance to the vacuum passage 230. Optionally, the gap 262 can have a cross-sectional area equal to the cross-sectional area of the vacuum passage 230, thereby uniformly directing the air flow from the vacuum passage 230 past the gap 262 between the deflector 180 and the entrance to the vacuum passage 230 and into the hopper 120. Alternatively, the gap 262 can have a cross-sectional area to the air flow that is greater than or less than the cross-sectional area of the vacuum passage 230. If the gap 262 were to have a cross-sectional area greater than the cross-sectional area of the vacuum passage 230, it can facilitate air flow at higher speeds in the vacuum passage 230. Conversely, if the gap 262 were to have a cross-sectional area less than the cross-sectional are of the vacuum passage 230, it can better direct debris into the hopper 120 and prevent debris from bouncing in the cleaning tool chamber 150. Accordingly, the cross-sectional area of the gap 262 can be adjustable based on whether a higher air flow in the vacuum speed or better debris direction is desired.

Referring back to FIG. 7 and referring now to FIG. 9, the outer skirt 220 can be positioned such that the outer skirt 220 is prevented from contacting the surface 152 on which the floor surface maintenance machine 100 is positioned as described previously. Optionally the inner skirt 210 is also prevented from contacting the surface 152 on which the floor surface maintenance machine 100 is positioned. However, during use, the inner skirt 210 may be more prone to misadjustment and may eventually contact the surface 152 during use. For example, the floor surface maintenance machine 100 may treat floor surfaces that are uneven (e.g., having undulations). The machine 100 may optionally turn when treating such floor surfaces. In such cases, the inner skirt 210 can be dragged by undulations (e.g., bumps) on the floor surface 152, leading to the inner skirt 210 being deflected. In such cases, the inner skirt 210 is prevented from being deflected when the inner skirt 210 contacts the surface 152 on which the floor surface maintenance machine 100 is positioned. Referring back to FIG. 7, in some such embodiments, the inner skirt 210 can comprise a guide flap 270 positioned proximal to a leading edge of the inner skirt 210, to prevent the entire inner skirt 210 from being deflected, turned, mis-aligned or damaged when the machine 100 treats an uneven floor surface 152. The guide flap 270 can be made of a material having higher flexibility than the inner skirt 210. Optionally, the guide flap 270 can be thinner than the remainder of the inner skirt 210. The guide flap 270 can flex when the machine 100 operates on an uneven surface 152 while preventing the inner skirt 210 from being deflected when the inner skirt 210 contacts the surface 152 on which the floor surface maintenance machine 100 is positioned.

In operation, the floor surface maintenance machine 100 is operated on a floor surface 152 to sweep particulate therefrom. When the vacuum system 130 is engaged, dirt and debris are directed from the floor surface 152 toward the hopper 120 due to vacuumized airflow generated by the vacuum system 130. The skirt assembly 200 substantially isolates the cleaning tool chamber 150 such that air from the cleaning tool chamber 150 is prevented from entering and/or pushing particulate in the vacuum passage 230 defined by the skirt assembly 200. Particulate matter is drawn into the vacuum passage 230 and directed toward the hopper 120, thereby preventing dusting at portions (e.g., lateral and rear sides 156) of the cleaning tool chamber 150 that are distal to the hopper 120 and/or vacuum system 130.

Advantages of embodiments disclosed herein include lower sensitivity to skirt mis-adjustment or damage due to the presence of two skirts. Routing of airflow is improved, thereby allowing sweeping to be conducted at lower vacuum source capacity (e.g., fan speed) thereby resulting in lower power requirements (e.g., a smaller battery). Improved routing of airflow also allows sweeping to be conducted outdoors in higher winds without dusting.

Thus, embodiments of the surface maintenance machine with a skirt assembly are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention.

The invention claimed is:

1. A floor surface maintenance machine, comprising:

a body;

wheels for supporting the body for movement over a surface;

a cleaning tool chamber housed toward a bottom portion of the body, the cleaning tool chamber comprising a first side, a second side, a third side and a fourth side;

one or more rotary broom housed in the cleaning tool chamber and substantially surrounded by the first, second, third and fourth sides thereof, the rotary broom extending from a bottom surface of the body, the rotary broom adapted to sweep particulate from the surface;

a vacuum system adapted to generate vacuum for drawing particulate swept by the rotary broom, an inlet of the vacuum system being positioned proximal to the first side; and a skirt assembly extending substantially around the second, third and fourth sides of the cleaning tool chamber, the skirt assembly having a vacuum passage defined therein, the vacuum passage extending substantially around the second, third and fourth sides and in fluid communication with the vacuum system to direct particulate within the vacuum passage toward the first side of the cleaning tool chamber, the skirt assembly not extending around the first side thereby permitting the vacuum system to draw particulate from within the vacuum passage defined in the second, third, and fourth sides, and direct the particulate while present in the vacuum passage toward the first side, a portion of the skirt assembly substantially fluidly isolating the cleaning tool chamber from the vacuum passage, whereby airflow in the cleaning tool chamber does not generally affect vacuum airflow in the vacuum passage.

2. The floor surface maintenance machine of claim 1, wherein the skirt assembly comprises an inner skirt positioned proximal to the second, third and fourth sides of the cleaning tool chamber, and an outer skirt spaced apart from the inner skirt, wherein, the outer and inner skirts define boundaries of the vacuum passage of the skirt assembly.

3. The floor surface maintenance machine of claim 2, wherein the inner skirt substantially isolates the vacuum passage from the cleaning tool chamber.

4. The floor surface maintenance machine of claim 3, wherein the rotary broom is rotatable, the rotation of the rotary broom generating air currents within the cleaning tool chamber.

5. The floor surface maintenance machine of claim 4, wherein the inner skirt isolates the vacuum passage from the cleaning tool chamber such that air currents generated by the rotary broom are fluidly isolated from vacuum generated by the vacuum system in the vacuum passage.

6. The floor surface maintenance machine of claim 2, wherein the inner skirt on the third and fourth sides is angled toward a transverse axis of the floor surface maintenance machine, the transverse axis being perpendicular to the surface on which the floor surface maintenance machine is positioned, the third and fourth sides being lateral to the transverse axis.

7. The floor surface maintenance machine of claim 6, wherein the inner skirt on the third and fourth sides forms an angle of between about 20 degrees and about 60 degrees with the transverse axis of the floor surface maintenance machine.

8. The floor surface maintenance machine of claim 1, wherein the skirt assembly substantially encloses the cleaning tool chamber except on the first side thereof.

9. The floor surface maintenance machine of claim 1, wherein the second side of the cleaning tool chamber is opposite to the inlet of the vacuum system.

10. A floor surface maintenance machine, comprising a body;

wheels for supporting the body for movement over a surface along a first direction;

a hopper for containing particulate swept by the floor surface maintenance machine;

a cleaning tool chamber comprising a front side, lateral sides and a rear side, wherein the rear side is generally toward the rear of a transverse axis of the floor surface maintenance machine when the floor surface maintenance machine is moving along the first direction;

one or more rotary brooms extending from a bottom surface of the body, the rotary broom adapted to sweep particulate from the surface and direct it toward the hopper, the rotary broom housed in the cleaning tool chamber;

a vacuum system adapted to generate vacuum for drawing particulate swept by the rotary broom and directing it to the hopper; and a skirt assembly comprising two rows of skirts the skirt assembly having a vacuum passage defined between the two rows of skirts and in fluid communication with the vacuum system, the two rows of skirts extending substantially around the lateral sides and the rear side of the cleaning tool chamber, the two rows of skirts terminating on the front side to define an inlet of the vacuum system to direct particulate within the rear side and the lateral sides of the vacuum passage toward the front side of the cleaning tool chamber and into the hopper, an inner row of the two rows of skirts substantially fluidly isolating the cleaning tool chamber from the vacuum passage, whereby airflow in the cleaning tool chamber does not generally affect vacuum airflow in the vacuum passage.

11. The floor surface maintenance machine of claim 10, further comprising a deflection panel adjacent to the front surface of the cleaning tool chamber, the deflection panel adapted to direct particulate into the hopper.

12. The floor surface maintenance machine of claim 11, further comprising one or more deflectors positioned proximal to the deflection panel and the vacuum passage to direct particulate into the hopper, the deflection panel prevented from intercepting an entrance to the vacuum passage and thereby facilitating air flow from near the lateral sides and rear side of the cleaning tool chamber toward the front side of the cleaning tool chamber.

13. The floor surface maintenance machine of claim 12, further comprising a gap between the deflection panel and the entrance to the vacuum passage, the gap having a cross-sectional area equal to a cross-sectional area of the vacuum passage, the gap being in fluid communication with the vacuum passage such that air flow from the vacuum passage flows past the gap between the deflection panel and the entrance to the vacuum passage and into the hopper.

14. A floor surface maintenance machine, comprising a body;

wheels for supporting the body for movement over a surface along a first direction;

one or more rotary brooms extending from a bottom surface of the body, the rotary broom adapted to sweep particulate from the surface; and a skirt assembly comprising an inner skirt positioned proximal to the rotary broom and an outer skirt spaced apart from the inner skirt, the inner and outer skirt defining a vacuum passage therebetween in fluid communication with a vacuum system for drawing particulate swept by the rotary broom, the skirt assembly extending on a rear side of the one or more rotary brooms, such that the vacuum passage extends on the rear side of the one or more rotary brooms, each of the inner and outer skirts not extending around a front side opposite to the rear side, the skirt assembly having a pair of lateral vacuum passages extending on lateral sides between the front side and the rear side, the lateral vacuum passages providing vacuum communication between the vacuum passage on the rear side and an inlet to the vacuum system on the front side, the inner skirt extending continuously on the rear side such that the inner skirt forms a fluid seal extending continuously along the rear side between the one or more rotary brooms and the outer skirt, such that particulate from within the vacuum passage is drawn toward an inlet of the vacuum system positioned on the front side, via the lateral vacuum passages, an edge of the outer skirt being spaced apart from a surface on which the floor surface maintenance machine is positioned, so as to form a first gap, the vacuum passage being fluidly isolated from the rotary broom when the inner skirt contacts the surface on which the floor surface maintenance machine is positioned.

15. The floor surface maintenance machine of claim 14, wherein the first gap between the outer skirt and the surface is between about 0.1 inches and about 0.15 inches.

16. The floor surface maintenance machine of claim 14, wherein the first gap between the outer skirt and the surface is in fluid communication with the vacuum passage such that particulate proximal to the outer skirt is drawn into the vacuum passage through the gap.

17. The floor surface maintenance machine of claim 14, wherein the inner skirt is more rigid than the outer skirt.

18. The floor surface maintenance machine of claim 17, wherein relative rigidity of the inner skirt with respect to the outer skirt prevents closure of the vacuum passage.

19. The floor surface maintenance machine of claim 17, wherein the outer skirt is made of a single layer fabric reinforced urethane or a single layer fabric reinforced neoprene.

20. The floor surface maintenance machine of claim 19, wherein the inner skirt adjacent to lateral sides of a cleaning tool chamber is made of fabric reinforced rubber having a thickness greater than a thickness of the single layer fabric reinforced urethane or single layer fabric reinforced neoprene.

21. The floor surface maintenance machine of claim 14, wherein the inner and outer skirts are substantially vertical with respect to the surface on which the floor surface maintenance machine is positioned.

* * * * *